US005731573A

United States Patent [19]

Allen et al.

[11] Patent Number: 5,731,573

[45] Date of Patent: Mar. 24, 1998

[54] TIDE CALCULATOR

[76] Inventors: Richard A. Allen; Christopher B. Allen; Alexander R. Allen, all of 29 Devons St., Concord, Mass. 01742

[21] Appl. No.: 652,315

[22] Filed: May 23, 1996

[51] Int. Cl.[6] ..... G06C 27/00; G06C 3/00

[52] U.S. Cl. ..... 235/78 R; 235/88 R; 235/88 N

[58] Field of Search ..... 235/78 R, 88 R, 235/88 N

[56] References Cited

U.S. PATENT DOCUMENTS

| | | | |
|---|---|---|---|
| 3,745,313 | 7/1973 | Spilhaus | 235/88 |
| 3,825,181 | 7/1974 | Banner | 235/88 |
| 3,982,104 | 9/1976 | Banner | 235/88 N |
| 4,035,617 | 7/1977 | Banner | 235/88 N |
| 4,194,111 | 3/1980 | Katz | 235/83 |
| 4,272,107 | 6/1981 | Elbow | 283/1 A |
| 4,585,927 | 4/1986 | Thompson | 235/7 OR |

*Primary Examiner*—Michael L. Gellner
*Assistant Examiner*—Daniel Chapik
*Attorney, Agent, or Firm*—Herbert L. Bello

[57] ABSTRACT

A pocket tide calculator is described which predicts tide times and moon phases in a visual display which gives the semi-diurnal tide times in any given day of the month and can be readily set for the following month. This device automatically leaves out the high or low tide which is alternately missing every 7.5 days. This invention incorporates a compressed time scale when compared with a normal 24-hour clock face which enables a concise display of the semi-diurnal tide cycle.

19 Claims, 2 Drawing Sheets

TIDE CALCULATOR

BACKGROUND OF THE INVENTION

1. Field of the Invention

The present invention relates to devices for predicting ocean tides and, more specifically, to devices for predicting the tide times of the semi-diurnal tide cycle.

2. Background Information

It is well known that for the purpose of predicting tide times, much complexity can be eliminated if the tides are primarily semi-diurnal. Indeed, conventional Admiralty Tide Tables use at least 30 constituents to predict tide events. Yet by using only one—namely 28.984 degrees per hour—tide time predictions for a specific location such as, for example, the city of Boston, are accurate to approximately plus or minus 30 minutes when compared to the Admiralty Tide Table predictions.

A knowledge of the moon's phase, the equivalent of adding a 30 degree/hr constituent, helps to qualitatively predict the stronger tides at new and full moon, but does not have an appreciable effect on the times of occurrence of the highs and lows of Boston. The elipticity of the moon's orbit also seems to have a negligible effect on the tide times at this part, although it does have an effect on the strength.

Most tide clocks and predictors which incorporate a visual display of high and low tide events do not indicate on which days certain events in the semi-diurnal tide cycle are missing. In particular, such clocks and predictors do not clearly indicate the days which have only three high and low tide events, rather than four. Also, particular devises, such as, for example, that disclosed in U.S. Pat. No. 3,825,181 to Banner, may indicate the time of one of the high tides in the particular day, however, additional calculations must be made in order to obtain the other tidal events of the day.

In general, these devices for predictions beyond twelve hours have been cumbersome to use. Most prior effort to make visual semi-diurnal tide time predictors for times longer that 12 hours have involved using the daily time lapse movement of 0.84 hours in conjunction with a high or low tide event since the high or low tide event occurs approximately 0.84 hours or approximately 50 minutes later each successive day. However, the proper display of the other three semi-diurnal tidal events had not been concise.

Thus, a need exists for an easy to use tide calculator which predicts and simultaneously displays all of the high and low tide events for a given date, while also indicating the dates on which a high or low tide event is missing, i.e. a high or low tide occurs only once.

SUMMARY OF THE INVENTION

In accordance with the above, it is an object of the present invention to provide an improved tide calculator.

It is an additional object of the present invention to provide an easy to use tide calculator which predicts and simultaneously displays all of the high and low tide events for a given date.

It is a further object of the present invention to provide a tide calculator which indicates the dates on which a high or low tide occurs only once.

Still further, it is an object of the present invention to provide a convenient and inexpensive way of predicting tide times and relative tide strengths.

According to an embodiment of this invention, a tide calculation and display device includes a base member having a date display and time scale indicia corresponding to time of day disposed thereon. A date disc is rotatably supported by the base member and has date indicia peripherally disposed thereon. The date disc is selectively rotatable to selectively display desired dates in the date display. A tide indicator is supported by the base member and is adapted for indicative registration with the time scale indicia. The tide indicator is also adapted for substantially unitary rotation with the date disc over a predetermined range of at least eight consecutive dates to indicate approximate times and number of all high and low tide events for each selectively displayed date within the predetermined range.

The present invention provides, in a second aspect, for indication of which dates have only three high and low tide events. In a third aspect, the present invention provides for indication of the relative magnitude of the high and low tide events by indication of the phase of the moon on the displayed date.

The present invention thus satisfies the need for an easy to use tide calculator which predicts and simultaneously displays all of the high and low tide events for a given date, while also indicating the dates on which a high or low tide event is missing, i.e. when a high or low tide occurs only once.

The above and other objects, features and advantages of this invention will be more readily apparent from a reading of the following detailed description of various aspects of the invention taken in conjunction with the accompanying drawings.

DETAILED DESCRIPTION OF THE PREFERRED EMBODIMENTS

Figure 1:
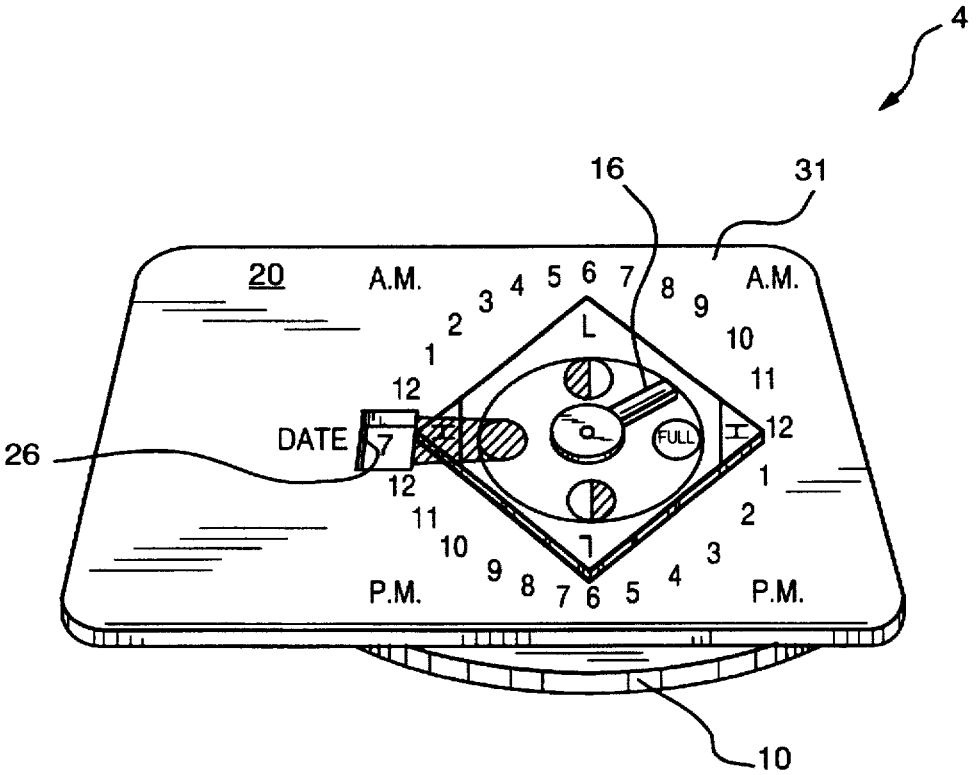
FIG. 1 is a perspective view of the tide calculator of the present invention.

Briefly described, as shown in FIG. 1, the present invention includes a relatively simple tide calculator 4 which provides a simple and clear means for predicting and simultaneously displaying the time and relative magnitude of all high and low tide events for a given date. As shown, tide calculator 4 includes a base member 20 having time scale indicia 31 corresponding to the time of day, and a date disc 10 having date indicia 24. Date disc 10 is rotatable relative to the base member to selectively display the dates of the month through a date window or display 26 disposed in the card. Rotation of the disc 10 will also serve to rotate a high/low tide indicator 14 and a moon phase indicator 16 therewith to indicate the hour of predicted high and low tides, and the phase of the moon, respectively, for the displayed date. Tide calculator 4 of the present invention and the operation thereof will be described in greater detail hereinafter.

Figure 2:
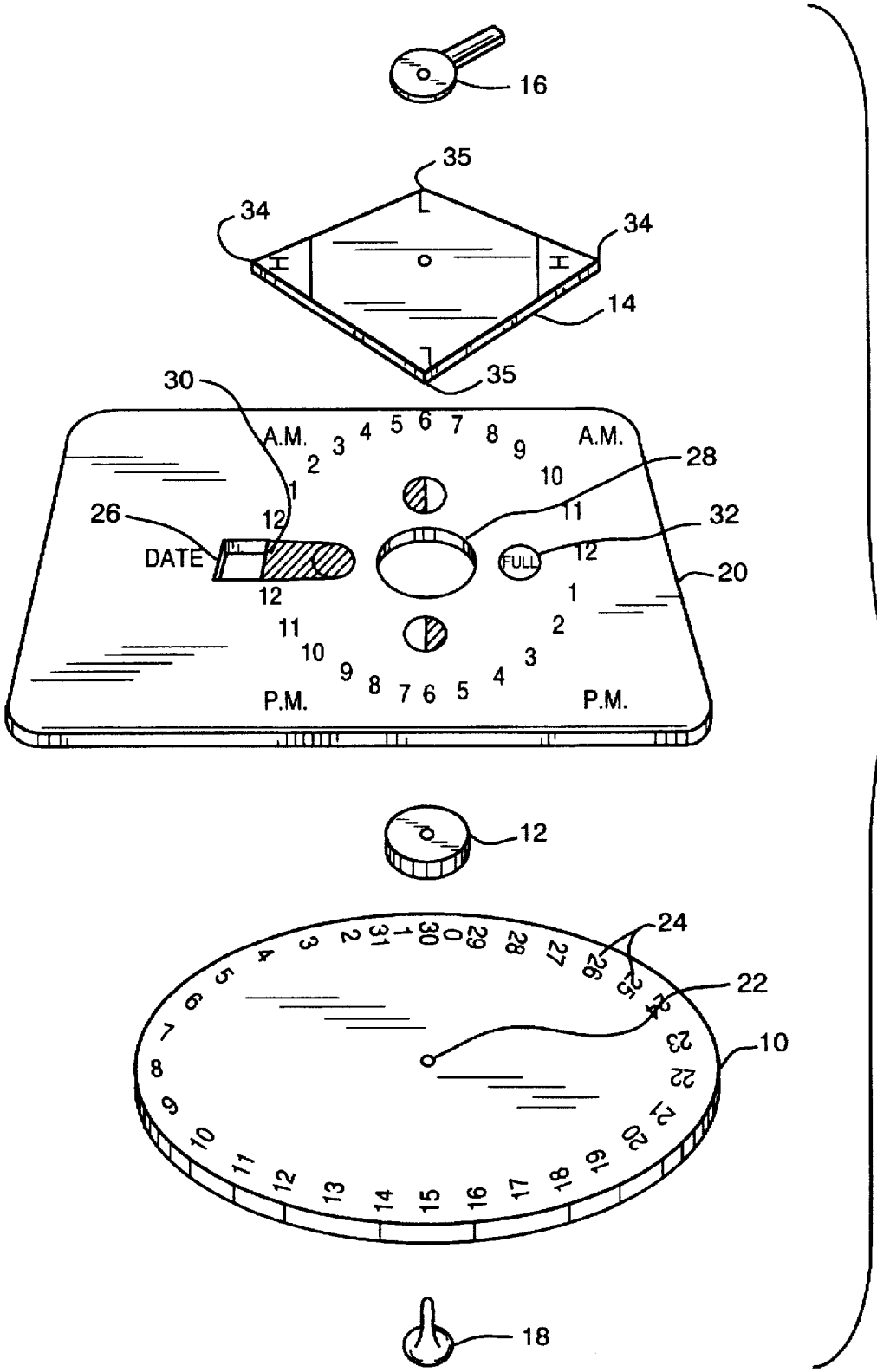
FIG. 2 is an exploded perspective view of the tide calculator of FIG. 1.

Referring now to FIG. 2, date disc 10, a bearing washer 12, high/low tide indicator 14, and moon phase indicator 16 are concentrically fastened to one another by a fastener 18 to facilitate rotation as a trait relative to base member 20.

Date disc 10 is preferably constructed from a semi-rigid flat, and preferably waterproof, material, such as sheet plastic or waterproofed cardboard and is generally circular in shape with a center hole 22, to receive fastener 18. Date indicia 24 includes numerals "0" to "31" that are spaced on one side of disc 10 in a progressively chronological counterclockwise direction. Date indicia 24 is oriented so that the individual dates will appear right side up in date window or display 26. The angular spacing between consecutive numerals or dates is approximately 12 degrees, specifically, 12.192 degrees. A "0" date is also included. As shown, the dates "0", "1" and "2" overlap between dates "29", "30" and "31." The "0" date provides a means at the end of one month to set the tide readings for the next month.

Bearing washer 12 serves to frictionally connect the high/low tide indicator 14 and moon phase indictor 16 to date disc 10. The thickness of bearing washer 12 is preferably slightly larger than that of base member 20 and its outside diameter is slightly less than a hole 28 in base member 20. The fastener 18, which connects date disc 10, bearing washer 12, high/low tide indicator 14 and moon phase indicator 16 is loose so that the high/low tide indicator and the moon phase indicator can each be adjusted or set by hand relative to the disc, and sufficiently tight to ensure that once adjusted, they remain fixed relative to one another and rotate as a unit or in a unitary manner with disc 10 relative to base member 20.

Base member 20 is preferably constructed from the same material as disc 10 and has hole 28 disposed in it to receive bearing washer 12. As mentioned hereinabove, the base member 20 also includes a viewing window or display 26. Time scale indicia 31 is imprinted on the face of the base member 20 and includes a compensation gap or region 30. The compensation gap 30 preferably comprises a demarcation which is dark colored or the same color as high tide indicia or arrows 34 or low tide indicia or arrows 35, disposed on high/low tide indicator 14, which will be discussed in greater detail hereinafter. The matching of colors serves to clearly indicate when an arrow 34 or 35 is placed proximate compensation gap 30, as will also be discussed more fully hereinafter. Alternatively, the demarcation may be replaced with a mask or covering (not shown) to cover the high or low arrow when proximate gap 30. The angular width of compensation gap 30 is sized to correspond to the approximately 50 minute temporal advance of respective tide events per day. Accordingly, the full 360 degrees of time scale indicia 31, including compensation gap 30, corresponds to the average time required for the moon to complete one orbit around the earth, or approximately 24 hours, 50 minutes. Compensation gap 30 thus has an angular width of approximately 12 degrees, and specifically, 12.192 degrees, measured from the center of rotation, or fastener 18. The compensation gap thus serves to compress the 24 hour portion of time scale indicia 31 from a full 360 degrees to 360 degrees minus the size of the compensation gap, or approximately 348 degrees, or in the preferred embodiment, 347.808 degrees. This remaining angular value is divided into 24 parts giving approximately 14 degrees (specifically 14.492 degrees) between each hour in time scale indicia 31. The time scale indicia can be broken either into A.M. and P.M., as shown, or kept as a 24 hour time scale (not shown). Moon phase indicia 32 are also placed on base member 20 and are viewed through a transparent portion of the high/low tide indicator 14, as will be discussed hereinafter.

High/low tide indicator 14 is preferably fabricated from a material similar to that of base member 20 and disc 10, with the exception that it is substantially transparent to facilitate viewing of moon phase indicia 32 as discussed hereinabove. High and low tide indicia or arrows 34 and 35, respectively, are alternately spaced 90 degrees from one another. This 90 degree spacing corresponds to the commonly known average of approximately 6.21 hours between alternate semi-diurnal high and low tide events.

In an alternate embodiment (not shown), high low tide indicator 14 may comprise two overlays such that the two high tide events and two low tide events may be adjustably set relative to each other. Such construction would then permit the present invention to better account for local variations in tidal events, such as, for example, with respect to tidal rivers where there tends to be a shortening of the time between low and high tide events.

Operation of the invention is relatively simple and is described in the following operational instructions which are preferably imprinted directly onto the tide calculator at a convenient location such as the rear of date disc 10:

To set: Observe time of high or low tide and phase of moon. Turn date disc to corresponding date and hold in place. Set high/low tide and moon phase indicators against time and moon scales. To use: mm date disc along with high/low tide and moon phase indicators to any other day in month to predict the time of high and low tides (in the same location as initially set at) and phase of moon. Note: strongest tides (spring tides) generally occur at full and new moon. To set for next month: with last day of current month in date window, hold H/L tide and moon phase indicators in place against time and moon phase scale. Then turn date disc to day "0" of next month.

Moreover, when a high tide arrow 34 or low tide arrow 35 falls on compensation gap 30, the respective high or low tide is missing on the date appearing in date window 26. Accordingly, the present invention provides a relatively simple means for predicting and simultaneously displaying all of the high and low tide events for a given date. In addition, the relative level of the tides is provided by the indication of the phase of the moon displayed for the date. The present invention also conveniently indicates the dates on which a high or low tide occurs only once.

The foregoing description is intended primarily for purposes of illustration. Although the invention has been shown and described with respect to an exemplary embodiment thereof, it should be understood by those skilled in the art that the foregoing and various other changes, omissions, and additions in the form and detail thereof may be made therein without departing from the spirit and scope of the invention.

Having thus described the invention, what is claimed is:

1. A tide calculation and display device comprising:

a base member having a date display window and time scale indicia corresponding to time of day thereon, said time scale indicia being a full 360 degree time scale with a compensation region and twenty-four evenly spaced hourly indicia, said compensation region corresponding to a time interval substantially equal to the daily temporal advance of respective high and low tide events;

a date disc having date indicia thereon, said base member and said date disc operatively connected to one another for relative rotatable movement, said date disc being selectively rotatable to selectively display desired dates in said date display, said date indicia having consecutively numbered demarcations "0" to "31" corresponding to consecutive dates, said "0" demarcation defining a means for setting tide readings at the end of one month for the beginning of the next month;

a tide indicator having high and low tide indicia thereon said base member and said tide indicator operatively connected to one another for relative rotatable movement, said tide indicator being adapted for indicative registration with said time scale indicia, said tide indicator being further adapted for selective settable rotation relative to said date disc and for substantially unitary rotation with said date disc relative to said base member over a predetermined range of dates to indicate approximate times and number of high and low tide events for each selectively displayed date within said predetermined range and dates.

2. The tide calculation and display device of claim 1, wherein said tide indicator is adapted for substantially unitary rotation with said date disc over a predetermined range of dates of at least eight consecutive dates.

3. The tide calculation and display device of claim 2, wherein said tide indicator is adapted for substantially unitary rotation with said date disc over a predetermined range of dates of at least one calendar month.

4. The tide calculation and display device of claim 1, further adapted to indicate approximate times and number of all high and low tide events for each selectively displayed date within said predetermined range of dates.

5. The tide calculation and display device of claim 4, wherein approximate times of all high and low tide events occurring on the displaying date are displayed simultaneously.

6. The tide calculation and display device of claim 5, wherein any high and low tide event absent on a displayed date is displayed simultaneously with said approximate times of all high and low tide events occurring on the displayed date.

7. The tide calculation and display device of claim 1, further comprising a magnitude indicator operatively disposed on said base member, said magnitude indicator adapted to indicate relative magnitude of the high and low tide events occurring on the displayed date within said predetermined range of dates.

8. The tide calculation and display device of claim 7, wherein said magnitude indicator includes a moon phase indicator adapted for indicative registration with moon phase indicia disposed on said base member to selectively indicate phase of the moon for each selectively displayed date within said predetermined range of dates.

9. The tide calculation and display device of claim 8, wherein said moon phase indicator is adapted for substantially unitary rotation with said date disc over said predetermined range of dates.

10. The tide calculation and display device of claim 1, wherein said tide indicator further includes high tide indicia and low tide indicia corresponding to each respective high and low tide event.

11. The tide calculation and display device of claim 10, further comprising high tide indicia and low tide indicia corresponding to two high tide events and two low tide events for each displayed date.

12. The tide calculation and display device of claim 10, wherein said high tide indicia and said low tide indicia comprise pairs of diametrically opposed arrows.

13. The tide calculation and display device of claim 1, wherein said compensation region provides an indication when a high and low tide event is absent from a selectively displayed date within said predetermined range of dates.

14. The tide calculation and display device of claim 13, wherein said compensation region corresponds to a time interval of approximately fifty minutes, said time scale indicia extending for a period of approximately twenty-four hours, fifty minutes.

15. The tide calculation and display device of claim 14, wherein said compensation region extends an angular distance of approximately twelve degrees relative to a center of rotation of said date disc.

16. The tide calculation and display device of claim 14, wherein said time scale indicia extends 360 degrees about a center of rotation of said date disc, having an angular distance of approximately fourteen degrees between each successive hour thereof.

17. A tide calculation and display device comprising:

a base member having a date display and time scale indicia corresponding to time of day disposed thereon, said time scale indicia being a full 360 degree time scale with a compensation region and twenty-four evenly spaced hourly indicia, said compensation region corresponding to a time interval substantially equal to the daily temporal advance of respective high and low tide events;

said time scale indicia having a compensation region disposed therein;

a date disc rotatably supported by said base member and having date indicia peripherally disposed thereon, said date indicia having consecutively numbered demarcations "0" to "31" corresponding to consecutive dates, said "0" demarcation defining a means for setting tide readings at the end of one month for the beginning of the next month, said date disc being selectively rotatable to selectively display desired dates in said date display;

a tide indicator supported by said base member, said tide indicator being adapted for indicative registration with said time scale indicia and for substantially unitary rotation with said date disc relative to said base member over a predetermined range of dates to indicate approximate times and number of all high and low tide events for each selectively displayed date within said predetermined range of dates.

18. A tide calculation and display device comprising:

a base member having a date display and time scale indicia corresponding to time of day disposed thereon;

said time scale indicia having a compensation region disposed therein;

a date disc rotatably supported by said base member and having date indicia disposed thereon, said date indicia having consecutive numbers "0" to "31" representing consecutive dates, said "0" demarcation defining a means for setting tide readings at the end of one month for the beginning of the next month, said date disc being selectively rotatable to selectively display desired dates in said date display;

a tide indicator supported by said base member, said tide indicator being adapted for indicative registration with said time scale indicia, said tide indicator being further adapted for selective settable rotation relative to said date disc and for substantially unitary rotation with said date disc relative to said base member over a predetermined range of dates to indicate approximate times and number of high and low tide events for each selectively displayed date within said predetermined range of dates.

19. A tide calculation and display device comprising:

a base member having a date display and time scale indicia corresponding to time of day disposed thereon;

a date disc rotatably supported by said base member and having date indicia disposed thereon, said date disc being selectively rotatable to selectively display desired dates in said date display, said date indicia having consecutively numbered demarcations "0" to "31" corresponding to consecutive dates, said "0" demarcation defining a means for setting tide readings at the end of one month for the beginning of the next month;

a tide indicator supported by said base member, said tide indicator being adapted for indicative registration with said time scale indicia and for substantially unitary rotation with said date disc relative to said base member over a predetermined range of dates of at least eight consecutive dates to simultaneously indicate approximate times of all high and low tide events for each selectively displayed date within said predetermined range of dates and to indicate when a displayed date has only three high and low tide events.

* * * * *